United States Patent [19]

Hall et al.

[11] Patent Number: 4,589,722

[45] Date of Patent: May 20, 1986

[54] FLIP-TOP ELECTRICAL CONNECTOR

[75] Inventors: Holland Hall, Mississauga; Richard Nielson, Burlington, both of Canada

[73] Assignee: Ilsco of Canada Limited, Ontario, Canada

[21] Appl. No.: 606,400

[22] Filed: May 2, 1984

[30] Foreign Application Priority Data

Jan. 19, 1984 [CA] Canada ..... 445669

[51] Int. Cl.[4] ..... H01R 4/40

[52] U.S. Cl. ..... 339/272 UC

[58] Field of Search ..... 339/272 R, 272 A, 272 UC, 339/264 C

[56] References Cited

U.S. PATENT DOCUMENTS

| | | | |
|---|---|---|---|
| 2,117,725 | 5/1938 | Johnson | 173/263 |
| 2,128,895 | 9/1938 | Buehring | 173/263 |
| 2,132,967 | 10/1938 | Pennell | 173/263 |
| 2,265,911 | 12/1941 | Landmeier | 339/272 UC |
| 2,746,025 | 5/1956 | Radack | 339/272 UC |
| 3,259,877 | 7/1966 | Norden | 339/272 UC |
| 3,268,853 | 8/1966 | Noker et al. | 339/269 |
| 3,559,156 | 1/1971 | Coley | 339/272 A |

FOREIGN PATENT DOCUMENTS

| | | | |
|---|---|---|---|
| 1362065 | 4/1964 | France | 339/272 UC |
| 2237327 | 2/1975 | France | 339/272 UC |

*Primary Examiner*—Eugene F. Desmond

*Attorney, Agent, or Firm*—Wood, Herron & Evans

[57] ABSTRACT

A connector for electrical conductors comprising a body member adapted to receive electrical connectors therein and having an opening thereto, a closure member adapted to pivotally slideably engage the body member about a moveable axis so as to close said opening, at least one projection presented by one of the members, catch means presented by the other member operable to catch the projection by pivotally sliding the closure relative the body member and about the moveable axis to a closed position and to release the projection by pivotally sliding the closure member relative the body member and about the moveable axis to an open position providing access to the opening, and a thread screw associated with one of the members for clamping the electrical conductors between the members in the closed position and for securing the projection to the catch means against dislodgement.

10 Claims, 4 Drawing Figures

FLIP-TOP ELECTRICAL CONNECTOR

FIELD OF THE INVENTION

This invention relates to an improved connector for electrical conductors, and more particularly is directed to the clamping of electrical conductors by utilizing members pivotally slideably engageable with one another, utilizing heat dissipating materials.

BACKGROUND OF THE INVENTION

The conventional electrical connector comprises of two parts or members which are adapted to clamp electrical conductors therebetween. A clamping means is usually associated with one of the members.

U.S. Pat. No. 2,117,725 discloses a body member in the form of a "U-shaped" yoke, the arms of which are provided with apertures, an abutment shoe which is adapted to slide within said apertures, and a movable clamp member opposing the abutment shoe.

U.S. Pat. No. 2,128,895 reveals a yoke having a pivotal bridging member adapted to pivotally swing downwardly relative said yoke to permit a line wire to enter the yoke past the the bridging member.

Still another alternative as described in U.S. Pat. No. 2,132,967 which illustrates a sleeve member adapted to receive a sliding bearing member for clamping electrodes therebetween, utilizing a movable clamp element.

Yet another arrangement is disclosed in U.S. Pat. No. 3,268,853 where a clamp jaw and stepped jaw are utilized to clamp electrical conductors therebetween by means of a threaded stem and wing nut.

Other arrangements in the prior art utilize a yoke member having aligned apertures in the arms thereof, a closure member hingedly connected to the arms thereof and having a threaded post carrying rotatable wings adapted to interlock with the apertures during clamping of electrical conductors between the members.

However, the electrical connectors now used present relatively complicated arrangements for clamping electrical conductors and quite often it is a difficult task to insert the electrical conductors into the connector particularly when the connector is confined to a limited space. Furthermore, connectors often heat up during usage.

OBJECTS OF THE INVENTION

It is an object of this invention to provide an improved connector for connecting electrical conductors and more particularly to securely clamp together electrical conductors which can be readily clamped and removed, particularly in a device having a limited space.

It is a further object of this invention to utilize heat dissipating material in the construction of the connector.

FEATURES OF THE INVENTION

One aspect of this invention resides in a body member having a bottom wall formation presenting two opposed peripheral upstanding side wall formations for receiving electrical conductors therein and having an opening at the top thereof, both side wall formations including aligned retaining slots opening along an edge thereof, and a closure member pivotally slideably connected to the body member about a movable axis so as to swing from a closed position where the closure member closes the opening to an open position where the closure membr provides access to the opening, the closure member including projections operably releasably engagable with the retaining slots to engage the retaining slots in the closed position by pivotally sliding the closure member and about said moveable axis to the body member to the closed position, and releasable by pivotally sliding the closure member and about said moveable axis relative the body member to the open position, the member including a clamp for clamping the electrical conductors between the members in the closed position and securing the projections to the retaining slots against dislodgement.

It is another aspect of this invention to provide a connector for electrical conductors comprising: a body member having a bottom wall formation presenting two opposed peripheral upstanding sidewall formations for receiving said electrical conductors therewithin and having an opening at the top thereof, both sidewall formations including aligned aperature means and aligned retaining slots opening along a edge thereof; a closure member presenting protrusions at one end thereof adapted to be retained for sliding movement in one direction within the confines of said aperature means and rotatable about an axis defined by said protrusions so as to swing from a closed position where said closure means closes said opening to an open position where said closure member provides access to said opening; said closure member including projections operably releasably engageable with said retaining slots to engage said retaining slots in said closed position by rotatably sliding said closure member relative said body member about said axis within the confines of said aperture means to said closed position and releasable from said retaining slots by rotatably sliding said closure member relative said body member about said axis within the confines of said aperture means to said open position where said closure member provides access to said opening; said closure member including clamp means for clamping said electrical conductors between said members in said closed position and securing said projections to said retaining slots against dislodgement so as to secure said members against relative displacement in said closed position.

DESCRIPTION OF THE DRAWINGS

These and other objects and features are illustrated and described in the following specification to be read in conjunction with the sheets of drawings in which.

DESCRIPTION OF THE INVENTION

Identical parts have been given identical numbers throughout the figures.

Figure 1:
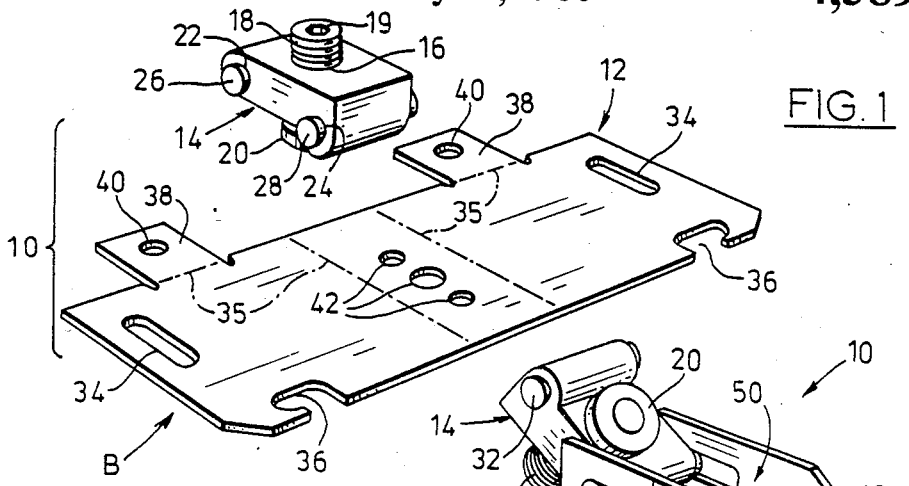
FIG. 1 is a partially exploded perspective view of the unassembled components of the electrical connector.

The electrical connector indicated as 10 in FIG. 1 includes a body member 12 and closure member or flip top 14. The closure member 14 includes a threaded aperture 16 adapted to receive a threaded screw 18 having a driving recess 19 at one end thereof and a clamping pad 20 at the other end thereof.

Figure 2:
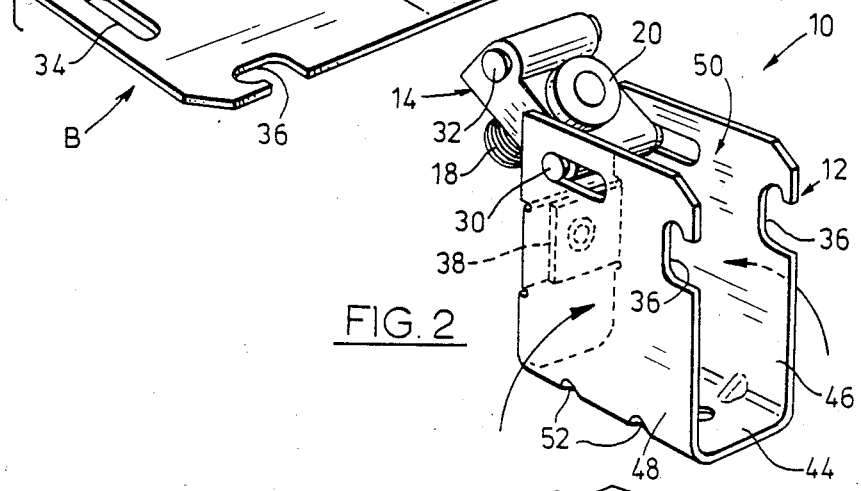
FIG. 2 is a perspective view of an assembled electrical connector showing the closure member providing access to the opening in the body member, taken from a point forwardly of and upwardly from the body member.

Closure member 14 includes two apertures 22 and 24 adapted to receive and fixedly retain therein pins 26 and 28 respectively so as to present protrusions 30 and projections 32 as illustrated in FIG. 2. It will be obvious to those skilled in the art that closure member 14 may be fabricated so as to present protrusions 30 and projections 32 integral therewith.

Body member 12 may be fabricated by stamping a piece of sheet metal (not shown) in a well known manner so as to present a blank B having the outline of body member 12 shown in FIG. 1. During the stamping process apertures 34, retaining slots 36, reinforcing flaps 38, rivet holes 40, and securing holes 42 are formed as shown in FIG. 1.

Figure 3:
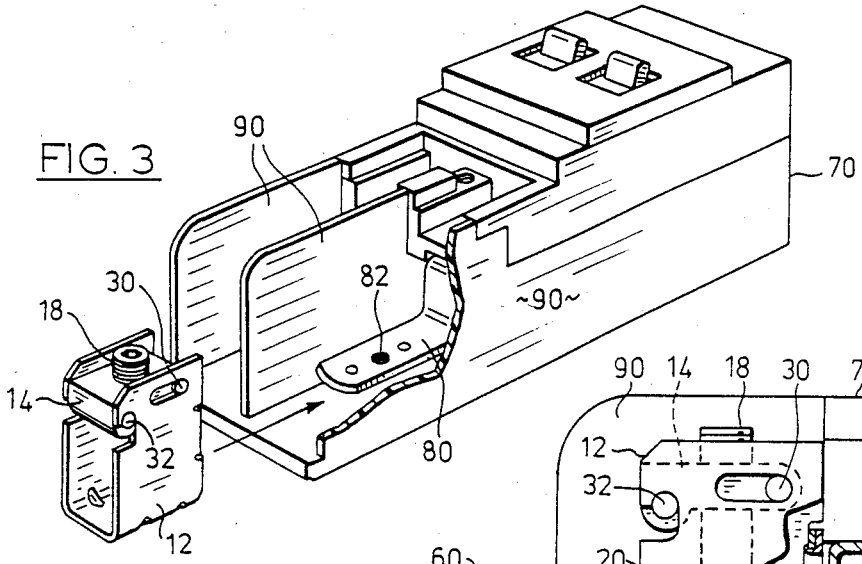
FIG. 3 is an exploded perspective view of the electrical connector illustrating the closure member in a closed position with the body member, in combination with the switch.
Figure 4:
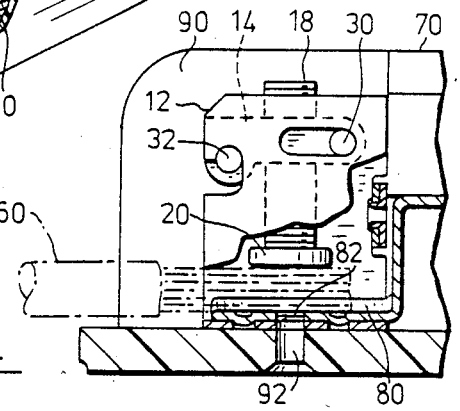
FIG. 4 is a partial side elevational view showing the electrical connector clamped to electrical conductors within a switch having a limited space.

The blank B is then folded along phantom lines 35 so as to present a body member 12 having a "U-shaped" cross section as shown in FIGS. 2, 3, and 4.

In the folded position of FIG. 2 the body member 12 presents a bottom wall formation 44 presenting peripherally two opposed upstanding side wall formations 46 and 48 having an opening 50 at the top thereof. The body member 12 presents aligned retaining slots 36 along the edges of both upstanding side wall formations 46 and 48 as illustrated in FIG. 2.

The closure member 14 is pivotally sidingly hingedly connected to the body member 12 by means of protrusions 30 which are adapted to engage the apertures 34 of the body member 12. The aperture 34 of body member 12 are oblong in shape which permits the closure member 14 to pivotally slideably swing relative to body member 12 about protrusions 30 and more particularly, about an axis of the protrusions 30, which axis is moveable within the confines of the oblong aperture 34.

When the electrical connector 10 is fully assembled the reinforcing flaps 38 are folded upon each other as best seen in FIG. 2 so that the rivet holes 40 presented by each of reinforcing flaps 38 are aligned with one another. The reinforcing flaps 38 may then be secured to one another by means of riveting (not shown) or by providing a tubular protruding structure on one of said reinforcing flaps 38 which is adapted to align with and protrude through a rivet hole 40 of said other reinforcing flap 38 as best seen in FIG. 4. The portion of the tubular structure protruding through the other reinforcing flap 38 is then flared outwardly so as to secure the reinforcing flaps 38. The riveted reinforcing flaps 38 present a reinforcing member connecting the side wall formation 46 and 48 which adds rigidity to the structure.

Serrations 52 are added along the fold lines 35 between the bottom wall formation 44 and side wall formations 46 and 48 respectively by an operation well known to those in the art and which comprises displacing the metal inwardly so as to add rigidity to the body member 12.

The bottom wall formation 44 presents a series of holes 42 so as to secure the electrical connector 10 to a foundation.

FIG. 3 illustrates the closure member 14 in a closed position whereby the access opening 50 is closed. In this position the engaging projections 32 are caught by retaining slots 36.

By referring to FIGS. 2 and 3 it is apparent that in order to free the projections 32 from the retaining slots 36 in the closed position illustrated in FIG. 2 the closure member 14 is pivotally slideably moveable relative the body member 12 about the axis moveably within the confines of the aperture 34 such that the protrusions 30 are adapted to slide within apertures 34 in the direction of the retaining slots 36 and at the same time the closure member 14 is pivotally slideably moveable downwardly towards the bottom wall formation 44 in a manner which permits the projections 32 to slide out of the retaining slots 36. Once the projections 32 are free of the retaining slots 36 the closure member 14 is pivotally slideably moveable about the moveable axis and away from bottom wall formation 44 to an open position illustrated in FIG. 2 which provides access to the opening 50. The open position illustrated in FIG. 2 allows an operator to easily insert cable or an electrical conductor through opening 50 into the zone bounded by the bottom wall formation 44 and said wall formation 46 and 48.

FIG. 3 illustrates the use of the electrical connector 10 with a device having limited space such as the switch 70. The switch 70 operates in a well known manner and includes an electrical conductor 80 disposed between side wall formations 90 which are adapted to receive the electrical connector 10. Electrical conductor 80 of switch 70 is insertable into the zone bounded by the side wall formation 46 and 48 and bottom wall formation 44 as best seen in FIG. 4. Electrical conductor 80 is provided with a hole 82 adapted to align with the largest hole 42 in bottom wall formation 44. The electrical switch 70 is also provided with a hole 92 which is aligned with hole 82 and the larger hole 42 of bottom wall formation 44. A securing screw (not shown) is insertable through the said holes, 92, 82, and 42 so as to secure the body member to the electrical conductor 80 and switch 70.

As will be appreciated the space provided between side wall formations 90 is limited. Accordingly, an electrical cable or conductor 60 is easily insertable through the opening 50 when the closure member 14 is in the open position illustrated in FIG. 2. Once the conductor 60 has been inserted into the body member the closure member 14 is pivotally slideably moveable relative the body member 12 towards the bottom wall formation 44 so that the projections 32 clear the upstanding edges of upstanding side wall formations 46 and 48 and are adjacent the retaining slots 36. The closure member 14 is then pivotally slidably moved so that the projections 32 engage with retaining slots 36, in a position where closure member 14 closes the access 50.

In this closed position the threaded screw 18 is rotatable by means of a tool (not shown) insertable in driving recess 20 which causes the threaded screw 18 to be displaced downwardly through the threaded aperture 16 towards the bottom wall formation 44. Upon continued threaded movement of the threaded screw 18 the clamping pad 20 clamps the electrical conductors 60 and 80 between the closure member 14 and body member 12 in the closed position and secures the projections 32 within the retaining slots 36 against dislodgement in the closed position so as to secure the members against relative displacement. The retaining slots 36 releasably catch the projections 32 by moving the closure member 14 between the two limit positions described.

FIG. 4 illustrates the electrical connector in its closed clamping position.

The materials of the preferred embodiment have been chosen to assist in the dissipation of heat generated in said electrical connector, and more particularly the body member 12 is comprised of commercial bronze identified in the trade as CA 220 and the closure member is comprised of aluminum.

Although the preferred embodiment as well as the operation has been specifically described in relation to the drawings, it should be understood that the variations of the preferred embodiment could easily be anticipated and achieved by a skilled man in the trade without departing from the spirit of this invention. In this regard it should be noted that the projections 32 could be presented by the body member 12 and retaining slots 36 presented by the closure member 14. Furthermore any number of projections 32 and retaining slots could be utilized so long as the members present at least one of the projections 32 and retaining slots 36 respectively. The threaded screw could be associated with the body member 12. Accordingly this invention should not be understood to be limited to the exact form revealed in the drawings.

The embodiments of the invention in which an exclusive property or privilege is claimed are defined as follows:

1. A connector for electrical conductors comprising:

(a) a body member having a bottom wall formation presenting two opposed peripheral upstanding side wall formations for receiving said electrical conductors therewithin and having an opening at the top thereof, both side wall formations including aligned retaining slots opening along an edge thereof, (b) a closure member pivotally slideably connected to said body member about a moveable axis so as to swing from a closed position where said closure member closes said opening to an open position where said closure member provides access to said opening, (c) said closure member including projections operably releasably engagable with said retaining slots to engage said retaining slots in said closed position by pivotally sliding said closure member relative said body member and about said moveable axis to said closed position and releasable from said retaining slots by pivotally sliding said closure member relative said body member and about said moveable axis to said open position where said closure member provides access to said opening, (d) said closure member including clamp means for clamping said electrical conductors between said members in said closed position and securing said projections to said retaining slots against dislodgement so as to secure said members against relative displacement in said closed position.

2. A connector as claimed in claim 1 wherein said side wall formations present aligned oblong apertures in the region remote from said retaining slots, and said closure member includes protrusions in the region remote from said projections, said oblong apertures adapted to receive and retain said protrusions during said movement about said axis within the confines of said apertures.

3. A connector as claimed in claim 1 wherein said side wall formations include a reinforcing member connecting said side wall formations.

4. A connector as claimed in claim 3 wherein said body member is comprised of commercial bronze and said closure member is comprised of aluminum.

5. A connector as claimed in claim 1 wherein said body member is comprised of commercial bronze and said closure member is comprised of aluminum.

6. A connector as claimed in claim 5 wherein said body member is comprised of commercial bronze identified as CA 220.

7. A connector for electrical conductors comprising:

(a) a body member having a bottom wall formation presenting two opposed peripheral upstanding sidewall formations for receiving said electrical conductors therewithin and having an opening at the top thereof, both sidewall formations including aligned aperture means and aligned retaining slots opening along an edge thereof (b) a closure member presenting protrusions at one end thereof adapted to be retained for sliding movement in one direction within the confines of said aligned aperture means and rotatable about an axis defined by said protrusions so as to swing from a closed position where said closure member closes said opening to an open position where said closure member provides access to said opening;

(c) said closure member including projections operably releasably engagable with said retaining slots to engage said retaining slots in said closed position by rotatably sliding said closure member relative said body member about said axis within the confines of said aperture means to said closed position and releasable from said retaining slots by rotatably sliding said closure member relative said body member about said axis within the confines of said aperture means to said open position where said closure member provides access to said opening (d) said closure member including clamp means for clamping said electrical conductors between said members in said closed position and securing said projections to said retaining slots against dislogement so as to secure said members against relative displacement in said closed position.

8. A connector as claimed in claim 7 wherein said aligned aperture means are located in the region adjacent ssaid opening and one upstanding edge of said upstanding wall formation and said aligned retaining slots open along the other upstanding edge thereof.

9. A connector as claimed in claim 7 wherein said protrusions slide within said aperture means in a direction substantially parallel with said bottom wall formation.

10. A connector as claimed in claim 9 wherein said aligned aperture means present aligned oblong apertures.

* * * * *